US006095228A

United States Patent [19]

Liu

[11] Patent Number: 6,095,228

[45] Date of Patent: Aug. 1, 2000

[54] TILT ROD SUPPORT FOR A VENETIAN BLIND

[76] Inventor: Tai-Ping Liu, No. 8, Lane 119, Sec. 3, Ta-Feng Rd., Tantzu Hsiang, Taichung Hsien, Taiwan

[21] Appl. No.: 09/322,186

[22] Filed: May 28, 1999

[51] Int. Cl.[7] ..... E06B 9/30

[52] U.S. Cl. ..... 160/173 R; 160/177 R

[58] Field of Search ..... 160/177 R, 176.1 R, 160/173 R, 178.1 R, 168.1 R, 178.3 R

[56] References Cited

U.S. PATENT DOCUMENTS

| | | | |
|---|---|---|---|
| 2,721,609 | 10/1955 | Rutledge | 160/177 R |
| 4,643,238 | 2/1987 | Tachikawa et al. | 160/177 R |
| 5,139,072 | 8/1992 | Marocco | 160/176.1 R |
| 5,267,598 | 12/1993 | Marocco | 160/177 R |
| 5,348,068 | 9/1994 | Elsenheimer et al. | 160/176.1 R |
| 5,538,066 | 7/1996 | Liu | 160/173 R |

*Primary Examiner*—David M. Purol
*Attorney, Agent, or Firm*—Bacon & Thomas PLLC

[57] ABSTRACT

A tilt rod support for a Venetian blind includes a U-shaped base plate including at least one through hole, and a rolling member mounted on the base plate and located above the through hole. A slat tilt adjustment cord extends through the through hole and slidably abuts the rolling member. The rolling member can be used to prevent the slat tilt adjustment cord from constantly contacting the solid edge of the through hole in order to protect the slat tilt adjustment cord.

3 Claims, 3 Drawing Sheets

TILT ROD SUPPORT FOR A VENETIAN BLIND

BACKGROUND OF THE INVENTION

1. Field of the Invention

The present invention relates to a tilt rod support, and more particularly to tilt rod support for a Venetian blind.

2. Description of the Related Art

The closest prior art of which the applicant is aware is disclosed in his U.S. Pat. No. 5,538,066, entitled "GUIDING BRACKET ASSEMBLY FOR A VENETIAN BLIND".

BRIEF SUMMARY OF THE INVENTION

In accordance with one aspect of the present invention, there is provided a tilt rod support for a Venetian blind comprising a base plate containing at least one through hole, and a rolling member mounted on the base plate and located above the at least one through hole. The base plate has two sides, and includes two side walls each extending upward from one of the two sides thereof.

The rolling member includes at least one rolling rod located above the at least one through hole. In accordance with one embodiment of the present invention, the rolling member includes two rolling rods located above the at least one through hole and spaced from each other such that a gap is defined between the two rolling rods and connects to the at least one through hole.

The tilt rod support fuither comprises at least one C-shaped holder secured on the base plate and containing two spaced retaining recesses each receiving one of the two corresponding rolling rods therein, and two stops each secured on the base plate and each containing two retaining depressions each receiving the distal end of each of the two rolling rods therein.

Alternatively, the rolling member includes at least one recessed rolling post located above the at least one through hole. In accordance with another embodiment of the present invention, the rolling member includes two recessed rolling posts located above the at least one through hole and spaced from each other such that a gap is defined between the two rolling posts and connects to the at least one through hole, Further benefits and advantages of the present invention will become apparent after a careful reading of the detailed description with appropriate reference to the accompanying drawings.

DETAILED DESCRIPTION OF THE INVENTION

Figure 1:
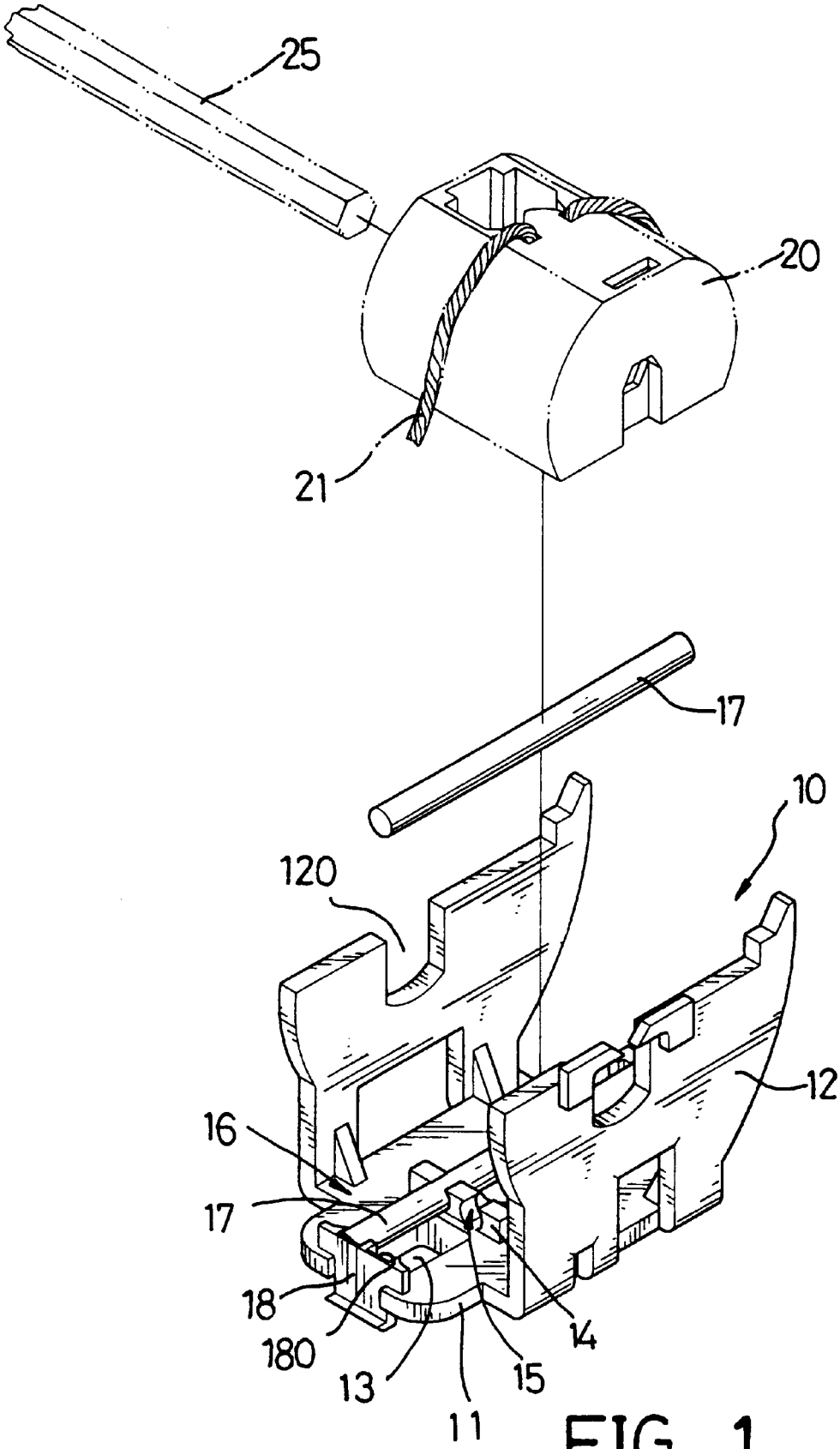
FIG. 1 is an exploded perspective view of a tilt rod support for a Venetian blind in accordance with the present invention.
Figure 2:
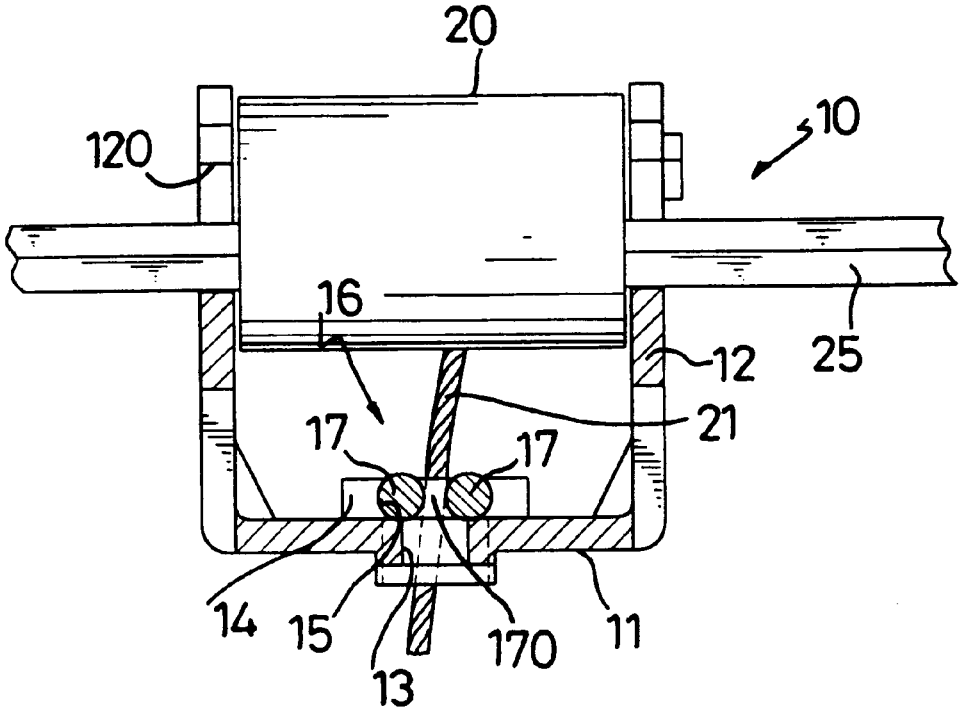
FIG. 2 is a side plan cross-sectional view of the tilt rod support as shown in FIG. 1.
Figure 3:
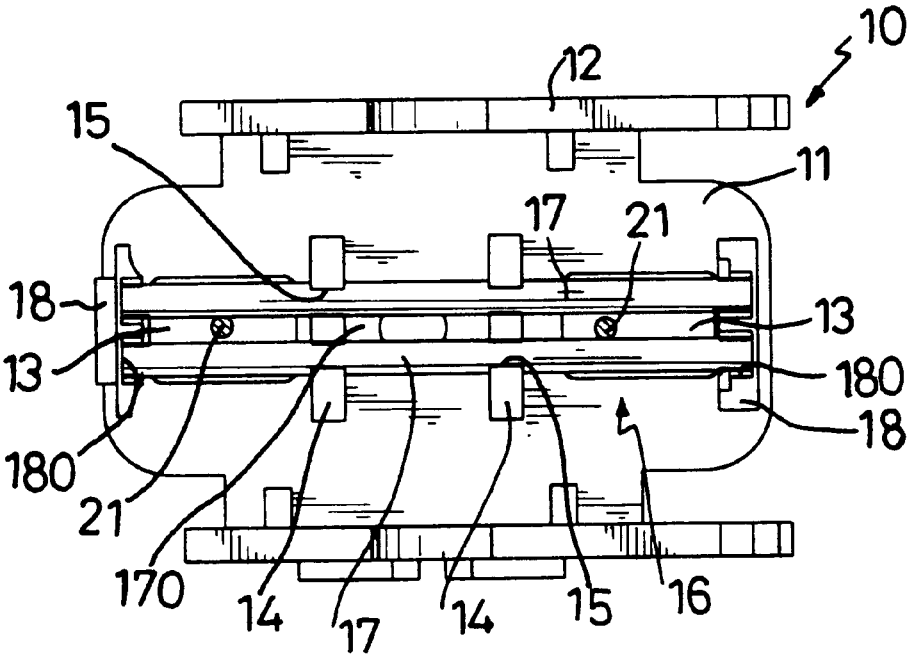
FIG. 3 is a top plan view of the tilt rod support as shown in FIG. 1.

Referring to the drawings and initially to FIGS. 1–3, a tilt rod support (10) for a Venetian blind in accordance with the present invention comprises a U-shaped base plate (11) including two side walls (12) and containing two through bores (13), and a rolling member (16) mounted on the base plate (11) and located above the two through holes (13).

The rolling member (16) includes two rolling rods (17) located above the two through bores (13) and spaced from each other such that a gap (170) is defined between the two rolling rods (17) and connects to the two through bores (13).

The tilt rod support (10) further comprises two C-shaped holders (14) each secured on the base plate (11) and each containing two spaced retaining recesses (15) each securely receiving one of the two corresponding rolling rods (17) therein, and two stops (18) each secured on the base plate (11) and each containing two retaining depressions (180) each securely receiving the distal end of each of the two rolling rods (17) therein In assembly, the tilt rod support (10) is secured in the headrail (not shown) of the Venetian blind which includes a tilt rod (25) that extends through the opening (120) arranged in each of the two side walls (12) of the base plate (11). A tilt drum (20) is secured to the tilt rod (25) to rotate therewith and located between the two side walls (12), and two slat tilt adjustment cords (21) each extends from the tilt drum (20). Each of the two slat tilt adjustment cords (21) extends through the gap (170) defined between the two rolling rods (17), and then through one of the two corresponding through bores (13), and is then secured to the slats (not shown) of the Venetian blind to adjust the tilt angle of the slats In such a manner, each of the two slat tilt adjustment cords (21) abuts the two rolling rods (17) so as to facilitate the movement of the two slat tilt adjustment cords (21) by the rotation of the two rolling rods (17), such that a user can adjust the tilt angles of the slats of the Venetian blind. In addition, each of the two slat tilt adjustment cords (21) is located between the two rolling rods (17) such that each of the two slat tilt adjustment cords (21) will not directly contact the bore sidewall of the through bore (13) of the base plate (11), thereby preventing the two slat tilt adjustment cords (21) from being worn out during long-term utilization so as to increase the lifespan of each of the two slat tilt adjustment cords (21). Further, only the holders (14) and the stops (18) are formed on the base plate (11) to simplify the molding process of making the tilt rod support (10), thereby reducing the cost of fabrication.

Figure 4:
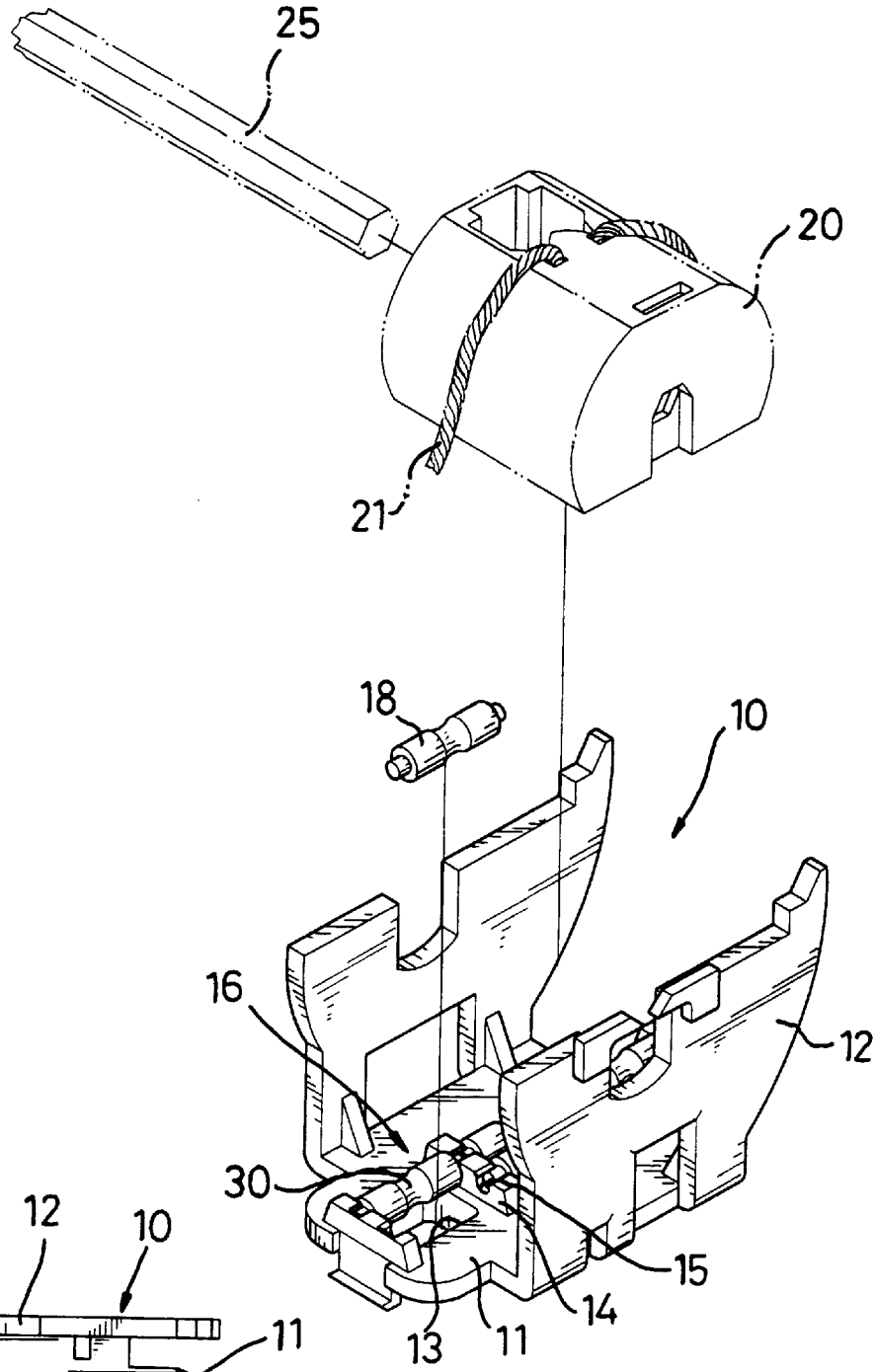
FIG. 4 is an exploded perspective view of a tilt rod support for a Venetian blind in accordance with another embodiment of the present invention.
Figure 5:
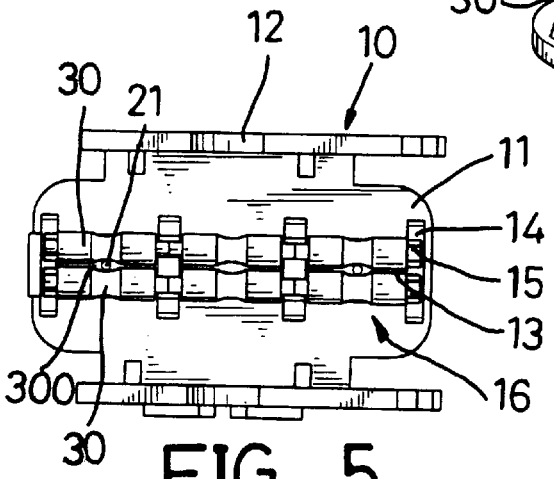
FIG. 5 is a top plan view of the tilt rod support as shown in FIG. 4.

Referring to FIGS. 4 and 5, in accordance with another embodiment of the present invention, the rolling member (16) includes three pairs of recessed rolling posts (30) forming reduced diameter portions spaced from each other such that a gap (300) is defined between the two adjacent rolling posts (30).

It should be clear to those skilled in the art that further embodiments may be made without departing from the scope of the present invention.

The present invention is by no means restricted to the above-described preferred embodiments, but covers all variations that might be implemented by using equivalent functional elements or devices that would be apparent to a person skilled in the art, or modifications that fall within the spirit and scope of the appended claims.

What is claimed is:

1. A tilt rod support for a Venetian blind comprising:

a base plate (11) containing at least two through bores (13), the at least two through bores (13) including bore sidewalls;

a rolling member (16) including at least two rolling rods (17) with distal ends, the rolling member (16) mounted on the base plate (11) and located above the at least two through bores (13);

at least one holder (14) attached to the base plate (11), the at least one holder (14) including at least two C-shaped recesses (15), each of the two C-shaped recesses (15) configured for receiving one of the rolling rods (17) therein;

the at least two rolling rods (17) spaced apart to form a gap (170) and configured to allow at least one adjustable cord (21) to pass through the gap (170) and one of the at least two through bores (13) without contacting the bore sidewalls; and two stops (18) each attached to the base plate (11), the two stops (18) each containing a retaining depression (180), the two stops (18) configured for receiving the distal ends of the rolling rods (17) therein.

2. The tilt rod support for a Venetian blind as recited in claim 1, wherein the base plate (11) further includes two sides that are substantially parallel to the length of the rolling rods (17), and two side walls (12) each extending upwardly from each one of the two sides thereof.

3. The tilt rod support for a Venetian blind as recited in claim 1, wherein the rolling rods (17) are recessed rolling posts (30) each having reduced diameter portions located above the at least two through holes (13).

* * * * *